United States Patent [19]

Halttula

[11] Patent Number: 4,890,372

[45] Date of Patent: Jan. 2, 1990

[54] PRESS ROLL FOR A PAPER MACHINE

[75] Inventor: Kyösti Halttula, Tampere, Finland

[73] Assignee: Oy Tampella AB, Tampere, Finland

[21] Appl. No.: 241,510

[22] Filed: Sep. 6, 1988

[30] Foreign Application Priority Data

Sep. 16, 1987 [FI] Finland ..... 874035

[51] Int. Cl.[4] ..... B21B 27/00

[52] U.S. Cl. ..... 29/123; 29/124; 29/125; 29/129.5

[58] Field of Search ..... 29/123, 124, 125, 129, 29/129.5; 100/93 RP, 155 R; 162/287

[56] References Cited

U.S. PATENT DOCUMENTS

| | | | |
|---|---|---|---|
| 4,107,831 | 8/1978 | Siegfried | 29/123 |
| 4,494,284 | 1/1985 | Post | 29/123 |
| 4,621,400 | 11/1986 | van der Graff | 29/123 |
| 4,658,486 | 4/1987 | Schönemann | 29/123 |
| 4,782,568 | 11/1988 | Halttula | 29/123 |

*Primary Examiner*—Howard N. Goldberg
*Assistant Examiner*—Irene Cuda
*Attorney, Agent, or Firm*—Ladas & Parry

[57] ABSTRACT

A press roll in a paper machine comprising a body cylinder mounted between two end pieces and fastened thereto, and a press cylinder surrounding the body cylinder and spaced apart therefrom. The press cylinder, which is rigid and receives the radial forces of the roll acting in the nip of the press, is fastened at the ends thereof radially immovably relative to the body of the roll. The press cylinder is at one end fastened to one end piece by means of axial bolts, whereby the conical surface of the press cylinder and a corresponding conical surface in the end piece are pressed against each other, thus clamping the press cylinder at the end thereof tightly against the end piece. At the other end of the roll the press cylinder is fastened to the other end piece of the roll by means of a separate fastening flange which is fastened both to the press cylinder and to the end piece by means of axial bolts. The fastening flange comprises an annular projection provided at both sides with a conical surface. On clamping the surfaces are pressed against conical surfaces provided on the inside of the press cylinder and on the end piece, respectively. The press cylinder can be detached and removed from the roll, so that it is withdrawn totally over the end piece of the roll in the axial direction.

8 Claims, 2 Drawing Sheets

PRESS ROLL FOR A PAPER MACHINE

This invention relates to a press roll in a paper or paper board machine, comprising a body formed by end pieces and a body cylinder mounted between the end pieces and attached thereto, and a press jacket surrounding the body cylinder and spaced apart therefrom.

This kind of roll is known e.g. from U.S. Pat. No. 4,782,568 in which the roll is provided with a resilient press cylinder maintained in place by means of the cup-like ends of the end pieces. In the patent application, the press cylinder is light in relation to the rest of the roll, and it is mounted between the end pieces in such a manner that the whole roll has to be removed from the paper machine for repair or maintenance; further, the press cylinder can be detached from the roll only by wholly disassembling one of its end pieces. Particularly with a press roll in a long-nip press, the lifting capacity of the apparatuses intended for handling the roll is often a restrictive factor determining the biggest possible roll size especially in old machines.

The object of the present invention is to provide a roll which is easy to repair without removing the roll and, on the other hand, by means of which it is possible to avoid the weight limitations and the resultant size limitations set by the lifting apparatuses especially with large-diameter rolls. This is achieved according to the invention in such a manner that the press jacket is a substantially rigid press cylinder; that when mounted in place the press cylinder is supported stationary in the direction of rotation of the roll and at both ends thereof in the radial direction of the roll; and that at least one end piece of the roll, attached to the body cylinder, is arranged to be passed through the press cylinder; whereby the press cylinder and the body of the roll are detachable from each other and mountable in place with respect to each other by displacing them relative to each other in the axial direction of the roll.

The basic idea of the invention is that the roll is formed by two separate parts. One part, i.e. the body, is formed by the end pieces and the body cylinder disposed therebetween, and the other part is formed by the rigid press cylinder, which is to receive the press force when mounted in place and which can be pushed in place or withdrawn in the axial direction of the roll over one end piece when the body is positioned in place in the machine. When the surface of the press cylinder is damaged, it is thereby possible to rapidly replace the cylinder with an intact one, thus avoiding long interruptions in production. Similarly, large-diameter and heavy cylinders can be mounted in place in two parts, whereby the lifting capacity of the lifting apparatuses can be considerably smaller than when lifting the whole cylinder at one go, whereby larger rolls than usual can be used.

Figure 1:
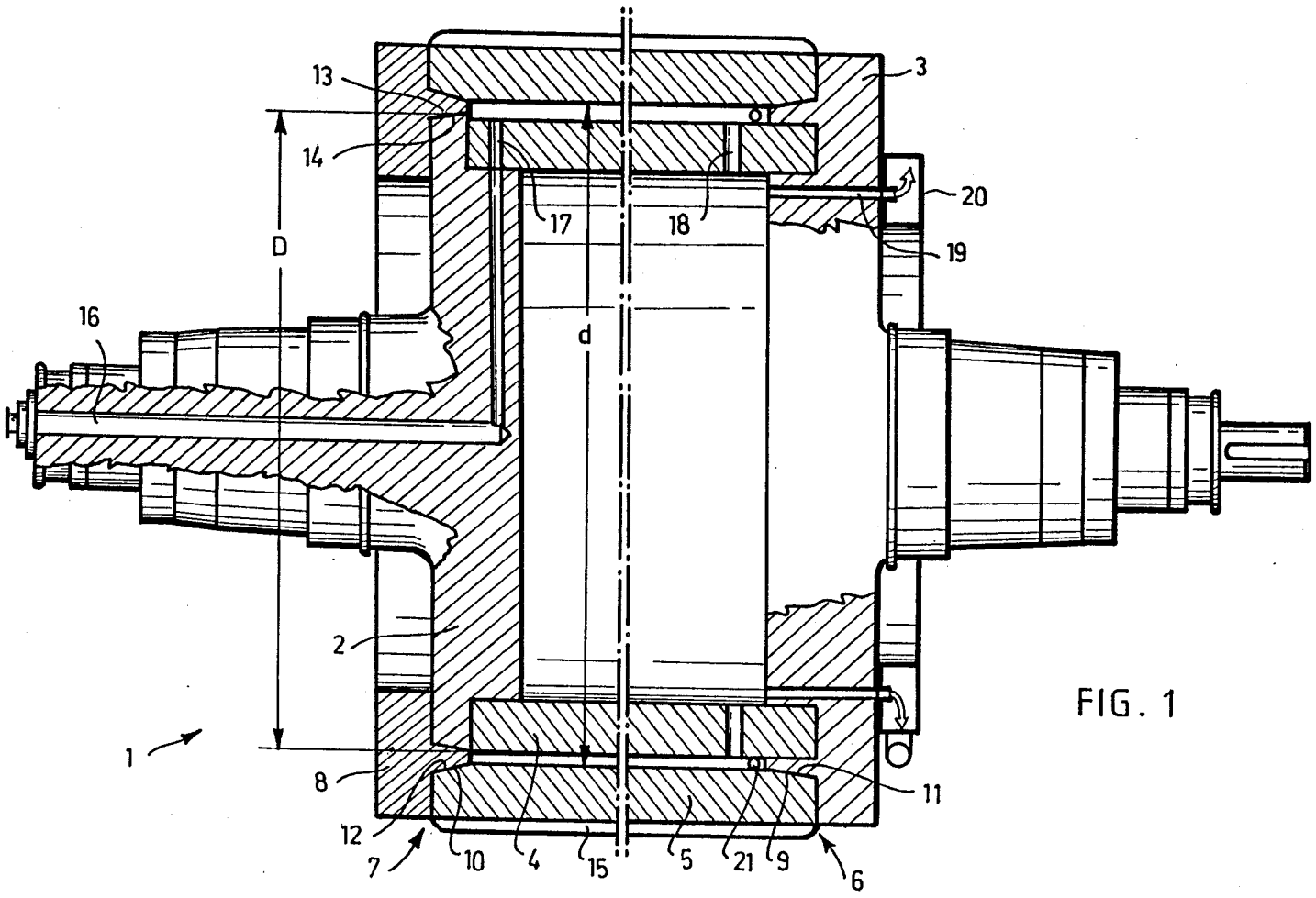
Figure 2:
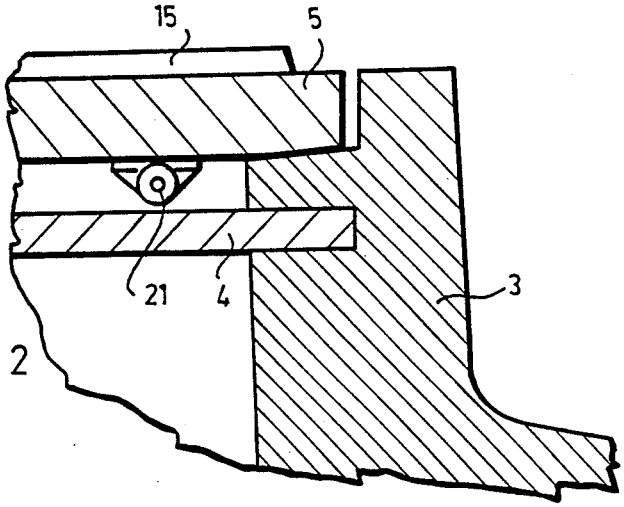
Figure 3:
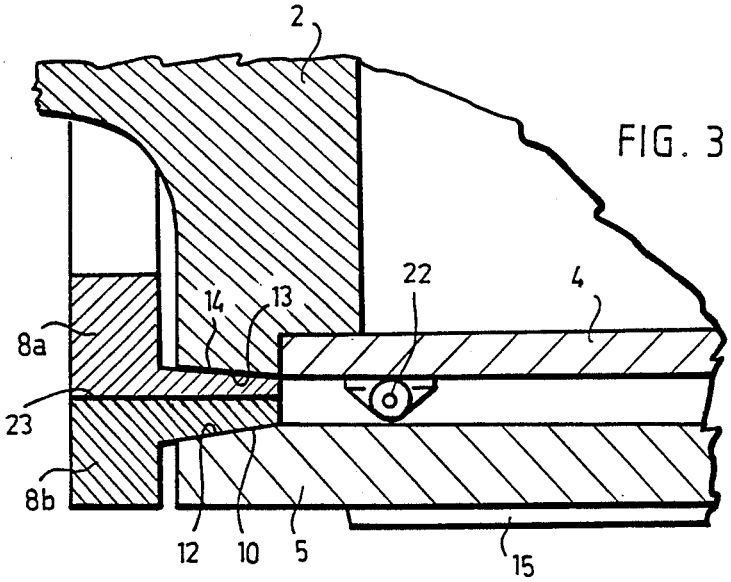

The invention will be described in more detail with reference to the attached FIGS. 1 to 3, wherein FIG. 1 is a cross-sectional view of a roll according to the invention, and FIGS. 2 and 3 are enlarged views of certain details shown in FIG. 1.

FIG. 1 shows a roll 1 the body of which is formed by a first and a second end piece 2 and 3 and a body cylinder 4 mounted between the end pieces 2 and 3 and fastened thereto. A press cylinder 5 is mounted around the body cylinder 4 at a distance therefrom. One end 6 of the press cylinder is fastened to the second end piece 3 and the other end 7 to the first end piece 2 by means of a separate fastening flange 8. The body of the roll 1 as such is sufficiently rigid to be handled without the press cylinder 5. The inner diameter of the press cylinder 5 is larger than the outer diameter D of the first end piece 2 of the roll 1. The press cylinder 5 can thereby be mounted in place within the roll 1 by pushing it from the end of the roll 1 over the end piece 2 on the body cylinder 4 until it rests on the second end piece 3 of the roll 1, whereto it is secured. The first end piece 2 of the roll 1 can be fastened to or supported on the press cylinder 5 by means of a fastening flange 8, which is fastened to the first end piece 2 and to the press cylinder 5. Both the body cylinder 4 and the press cylinder 5 are fastened by means of conventional bolt joints, which are generally known and therefore will not be more closely described herein. Both ends 6 and 7 of the press cylinder 5 are provided with internal conical surfaces 9 and 10 which bear on conical surfaces 11 and 12 of similar shape on the second end piece 3 and the fastening flange 8. Correspondingly, the fastening flange bears with another conical surface 13 on a conical surface 14 of similar shape in the first end piece.

When assembling the roll 1, the body cylinder 4 is fastened to the end pieces 2 and 3 by means of a conventional axial bolt joint formed by a number of bolts going through the end piece 2 or 3 into the body cylinder 4, whereby a substantially rigid body is formed. Thereafter the body can be mounted in place in a paper machine or the like so that the bearing housing of one end of the roll 1 is secured in place to the body of a press or the like, and the other end is left detached from the body, whereby the roll 1 is supported e.g. at the body cylinder 4 so that the roll is roughly in the right position. Thereafter the press cylinder 5 is pushed from the detached end of the roll 1 over the end piece 2 having a smaller outer diameter D than the inner diameter d of the press cylinder 5 onto the body cylinder 4 until the press cylinder 5 reaches the second end piece 3 of the roll. During the pushing the support point of the roll has to be changed in order that the body cylinder 4 could be brought in place; this, however, is a prior art technique in the handling of rolls, wherefore it will not be described more closely herein.

The press cylinder is fastened to the second end piece 3 by means of bolts to be driven in place in the axial direction of the roll 1 through said end piece into the press cylinder 5. Thereby the conical surface 9 on the inside of the press cylinder 5 and the conical surface 11 of the end piece 3 are pressed against each other, and the press cylinder 5 is centered with respect to the end piece 3 and, on the other hand, its end 6 is supported stationary in the radial direction of the roll 1.

Correspondingly, a fastening flange 8 is provided at the other end of the roll 1. The flange is fastened both to the press cylinder 5 and the first end piece 2 by means of bolts extending in the axial direction of the roll 1. Conical surfaces 12 and 13 in an annular projection in the fastening flange 8 are pressed against conical surfaces 10 and 14 of similar shape in the press cylinder 5 and the first end piece 2, respectively, so that this end of the press cylinder 5 is centered with respect to the end piece 2, and the press cylinder 5 is supported stationary in the radial direction of the roll at that end.

The axial joints as well as the radial joints possibly required between the roll end piece and the roll cylinder and the use of such joints are generally known, wherefore they will not be described more closely herein.

Depending on the use in each particular case, the roll 1, or more precisely, the press cylinder 5 can be coated with a resilient coating material 15 for increasing the nip width. Furthermore, the temperature of the roll 1 can be adjusted by introducing a medium of desired temperature between the press cylinder 5 and the body cylinder 4 through a channel 16 in the first end piece 2 and a channel 17 in the body cylinder 4 and further away from between the cylinders 4 and 5 through a discharge channel 18 in the body cylinder 4 and a channel 19 in the second end piece 3 into a receiving chamber 20 to be further discharged therefrom.

FIG. 2 is a more detailed view of the joint between the press cylinder 5 and the end piece 3. It appears from the figure that a clearance is provided between the press cylinder 5 and the end piece 3 in the axial direction of the roll 1, whereby the conical surface 9 of the press cylinder 5 can be clamped steadily against the conical surface 11 of the end piece 3. It further appears from FIG. 2 that a bearing 21 is secured to the inside of the press cylinder 5 for supporting the press cylinder 5 in the axial direction of the roll 1 when it is displaced along the body cylinder 4. This kind of bearings can be provided at suitable intervals in the peripheral direction of the body cylinder 4, whereby the position of the roll 1 in the direction of rotation thereof is insignificant during assembly and disassembly.

FIG. 3 shows a bearing 22 secured to the body cylinder 4 and corresponding to the bearing 21. The inside of the press cylinder 5 passes along the bearing 22 during assembly and disassembly. There may be provided several bearings in the longitudinal direction of both the body cylinder 4 and the press cylinder 5; however, it may be advisable to leave clearances between the bearings and the surfaces due to possible deflection, so that when the roll 1 is in operation condition, the bearings 21 and 22 do not make contact with the surfaces.

The fastening flange 8 of the press cylinder 5 can be constructed in various ways. FIG. 3 shows an embodiment in which the fastening flange 8 is formed by two separate flange members 8*a* and 8*b*, which are separated from each other by a cylinder surface 23 parallel with the surface of the roll 1, whereby the members 8*a* and 8*b* are displaceable in the axial direction of the roll with respect to each other. This is of advantage especially when the temperature of the press cylinder 5 of the roll 1 may considerably differ from the temperature of the body cylinder 4 of the roll 1, so that their length variations differ considerably from each other, or when the press cylinder 5 is centered with respect to the body cylinder 4 during the assembly of the press roll. A separate bearing bushing can be provided between the flange members 8*a*and 8*b*, or they can be dimensioned so as to fit together in some other way. In this particular embodiment, the member 8*a* is fastened by means of a bolt joint to the end piece 2 and the member 8*b* correspondingly to the press cylinder 5 when the cylinder surface 23 separating the members 8*a* and 8*b* is positioned between the conical surfaces 12 and 13. Each member is thereby clamped separately against the respective conical surfaces 14 and 10 for centering and supporting in the radial direction.

The invention is by no means restricted to the above embodiments, but it can be modified within the scope of the claims as desired. Accordingly, the fastening flange, e.g. by means of which the press cylinder is secured to the body of the roll, may be integral with the press cylinder. Similarly, a fastening flange can be provided at both ends of the roll, and the press cylinder can be removed from the roll or mounted therein at either end. Furthermore, it is not necessary to assemble the roll in situ but it can be assembled in advance before being positioned in place. On mounting the press cylinder it is possible to use fixedly mounted bearings or separate detachable mountings or bearings, etc. Further, the invention can be applied in such a manner that the press cylinder is left in place and supported suitably, if required, and the body of the roll is withdrawn from the press cylinder for the maintenance of the body, for instance. If both roll end pieces are arranged such that the body and the press cylinder are displaceable with respect to each other in either direction, it is possible to detach either the press cylinder or the roll body in the same roll, as required.

I claim:

1. A press roll for a paper or paper board machine, comprising a body forming by end pieces and a body cylinder mounted between the end pieces and attached thereto, and a press jacket surrounding the body cylinder and spaced apart therefrom, said press jacket being a substantially rigid press cylinder and being supported stationary in the direction of rotation of the roll and at both ends thereof in the radial direction of the roll when mounted in place; and at least one end piece of the roll, attached to the body cylinder, having an outermost diameter that is smaller than an inner of diameter of the press cylinder;

whereby the press cylinder and the body of the roll are detachable from each other and mountable in place with respect to each other by displacing them relative to each other in the axial direction of the roll.

2. A roll according to claim 1, wherein the press cylinder is at least at one end thereof supported on one end piece of the roll by means of a fastening flange.

3. A roll according to claim 2, wherein the fastening flange is a separate part which is fastened both to the press cylinder and one end piece.

4. A roll according to claim 2, wherein the fastening flange is formed by two members which are separated by a cylinder surface parallel with the surface of the roll and which are displaceable with respect to each other.

5. A roll according to claim 2 wherein the press cylinder is arranged to bear on the body of the roll with conical surfaces.

6. A roll according to claim 5, wherein the conical surface at one end of the press cylinder is arranged to bear on a corresponding conical surface in one end piece of the roll, and the conical surface at the other end thereof is arranged to bear on a corresponding conical surface in the fastening flange.

7. A roll according to claim 1 wherein at least one bearing mounted rotatably with respect to the press cylinder and the body cylinder is provided between the press cylinder and the body cylinder, the press cylinder being displaceable on said bearing in the axial direction of the body cylinder while supported by the body cylinder.

8. A roll according to claim 1 wherein the roll comprises channels for introducing a medium between the press cylinder and the body cylinder and away therefrom for adjusting the temperature of the press cylinder.

* * * * *